US008870019B2

(12) United States Patent
Massad

(10) Patent No.: US 8,870,019 B2
(45) Date of Patent: Oct. 28, 2014

(54) TIP RESISTANT BEVERAGE CONTAINER HAVING INTERNAL BALANCE MASS

(76) Inventor: Gary L. Massad, Oklahoma City, OK (US)

( * ) Notice: Subject to any disclaimer, the term of this patent is extended or adjusted under 35 U.S.C. 154(b) by 0 days.

(21) Appl. No.: 13/453,839

(22) Filed: Apr. 23, 2012

(65) Prior Publication Data

US 2012/0205340 A1 Aug. 16, 2012

Related U.S. Application Data

(62) Division of application No. 11/406,613, filed on Apr. 19, 2006, now Pat. No. 8,162,170.

(60) Provisional application No. 60/672,714, filed on Apr. 19, 2005.

(51) Int. Cl.

| | |
|---|---|
| ***B65D 25/20*** | (2006.01) |
| ***A47J 41/00*** | (2006.01) |
| ***B65D 81/38*** | (2006.01) |
| ***F25D 3/08*** | (2006.01) |
| ***B65D 25/24*** | (2006.01) |
| ***B65D 17/00*** | (2006.01) |

(52) U.S. Cl.

CPC ..... *B65D 25/24* (2013.01); *B65D 17/02* (2013.01)

USPC . 220/739; 220/592.17; 220/630; 248/346.11; 62/457.4

(58) Field of Classification Search

USPC ..... 220/571, 571.1, 603, 625, 626, 628, 220/630–632, 636, 729, 731, DIG. 5, 8, 220/23.83–23.89, 592.17, 737, 739; 248/346.11, 311.2; 62/457.4

See application file for complete search history.

(56) References Cited

U.S. PATENT DOCUMENTS

| | | | | |
|---|---|---|---|---|
| 62,949 | A | 3/1867 | Farley | |
| 821,028 | A | 5/1906 | Voss | |
| 821,208 | A * | 5/1906 | Voss | 248/346.11 |
| 937,850 | A | 10/1909 | Parker | |
| 1,300,867 | A | 4/1919 | Pick | |
| 1,338,106 | A | 4/1920 | Ruthven | |
| 2,041,563 | A | 5/1936 | Meinecke | |
| D133,703 | S | 9/1942 | Parker | |
| 2,587,237 | A | 7/1949 | Sinaiko | |
| 2,591,374 | A | 4/1952 | Place | |
| 2,601,767 | A | 7/1952 | Wall | |
| 2,784,577 | A | 7/1957 | Beaham | |
| 2,799,147 | A | 7/1957 | Crawford | |
| 2,856,095 | A | 10/1958 | Schnabel | |

(Continued)

*Primary Examiner* — Anthony Stashick
*Assistant Examiner* — Ned A Walker
(74) *Attorney, Agent, or Firm* — Daniel P. Dooley; Hall Estill Attorneys at Law

(57) ABSTRACT

A beverage container that includes at least a bottom portion with a side portion extending from the bottom portion, and a balance mass in pressing engagement with the bottom portion is disclosed. The balance mass is adjacent an inner surface of the bottom portion in a preferred embodiment, and adjacent an outer surface in an alternate preferred embodiment. In each embodiment, the balance mass includes at least a core portion encapsulated by an encapsulant, in which the density of the core is greater than the density of a beverage of the beverage container. In the alternate preferred embodiment, the balance mass further includes a tip lip portion with a condensate retention ridge, and a condensate aperture. The condensate retention ridge, in cooperation with a side portion of the balance mass, forms a condensate channel, and the condensate aperture drains condensate from the condensate channel.

3 Claims, 5 Drawing Sheets

(56) References Cited

U.S. PATENT DOCUMENTS

| | | | | |
|---|---|---|---|---|
| 2,885,108 | A | 5/1959 | Donoghue | |
| 2,936,926 | A | 5/1960 | Miller | |
| 2,937,872 | A | 5/1960 | Gilman | |
| 2,968,888 | A | 1/1961 | Borah | |
| 2,997,199 | A | 8/1961 | Ramon | |
| 3,010,602 | A | 11/1961 | Randolph | |
| 3,013,688 | A | 12/1961 | Luning | |
| 3,028,702 | A | 4/1962 | St. Cyr | |
| 3,079,037 | A | 2/1963 | Schechter | |
| 3,120,077 | A | 2/1964 | Stoffel | |
| 3,246,786 | A | 4/1966 | Danforth | |
| 3,302,428 | A | 2/1967 | Paquin et al. | |
| 3,393,892 | A | 7/1968 | Buck | |
| 3,524,614 | A | 8/1970 | Sorth | |
| 3,543,287 | A | 11/1970 | Henkel | |
| 3,606,074 | A | 9/1971 | Hayes | |
| 3,744,671 | A * | 7/1973 | Saunders, Jr. | 220/698 |
| 3,744,674 | A | 7/1973 | Funke | |
| 3,762,591 | A | 10/1973 | Gray | |
| 3,808,084 | A | 4/1974 | Doty | |
| 3,831,209 | A | 8/1974 | Clingman | |
| 3,966,077 | A | 6/1976 | Jardine | |
| 4,040,549 | A | 8/1977 | Sadler | |
| 4,055,273 | A | 10/1977 | Jones | |
| 4,089,498 | A | 5/1978 | Woodruff | |
| 4,096,966 | A | 6/1978 | Korshak | |
| 4,127,211 | A | 11/1978 | Zerbey | |
| 4,157,707 | A | 6/1979 | Schwind et al. | |
| 4,303,170 | A | 12/1981 | Panicci | |
| 4,383,422 | A | 5/1983 | Gordon et al. | |
| 4,388,996 | A | 6/1983 | Panicci | |
| 4,591,066 | A | 5/1986 | Moen | |
| 4,699,282 | A | 10/1987 | Farrar | |
| D293,642 | S | 1/1988 | Rubbright et al. | |
| 4,733,790 | A | 3/1988 | Stein | |
| 4,745,776 | A | 5/1988 | Clark | |
| 4,756,497 | A | 7/1988 | Lan | |
| 4,759,524 | A | 7/1988 | Anderson | |
| 4,829,618 | A | 5/1989 | McKee | |
| 4,836,488 | A | 6/1989 | Ross | |
| 4,858,872 | A | 8/1989 | Witt | |
| 4,892,215 | A | 1/1990 | Carlson et al. | |
| 4,928,848 | A | 5/1990 | Ballway | |
| 4,964,527 | A | 10/1990 | Martin | |
| 4,989,415 | A | 2/1991 | Lombness | |
| 5,052,582 | A | 10/1991 | Hall | |
| 5,088,948 | A | 2/1992 | Scheurer | |
| 5,150,869 | A | 9/1992 | Gould et al. | |
| 5,180,077 | A | 1/1993 | Lewis | |
| 5,212,963 | A | 5/1993 | McGinnis | |
| 5,273,182 | A | 12/1993 | Laybourne | |
| 5,294,018 | A | 3/1994 | Boucher | |
| 5,312,013 | A | 5/1994 | Bridges | |
| 5,465,891 | A | 11/1995 | Bridges | |
| 5,481,823 | A | 1/1996 | Hoover et al. | |
| 5,601,744 | A | 2/1997 | Baldwin | |
| 5,653,124 | A | 8/1997 | Weber | |
| 5,669,538 | A | 9/1997 | Ward | |
| 5,727,709 | A | 3/1998 | Nobile | |
| 5,842,675 | A | 12/1998 | Davitt | |
| 5,845,499 | A | 12/1998 | Montesanto | |
| 5,904,267 | A | 5/1999 | Thompson | |
| 5,975,333 | A | 11/1999 | Lee | |
| 5,984,156 | A | 11/1999 | Bridges | |
| 6,089,519 | A | 7/2000 | Laybourne | |
| 6,101,838 | A | 8/2000 | Teague | |
| 6,168,037 | B1 | 1/2001 | Grimard | |
| 6,305,656 | B1 | 10/2001 | Wemyss | |
| 6,511,031 | B2 * | 1/2003 | Lin | 248/346.11 |
| 6,530,496 | B2 | 3/2003 | Moran | |
| 6,612,943 | B2 | 9/2003 | Beers | |
| 6,640,992 | B1 | 11/2003 | Berger et al. | |
| 6,764,622 | B2 | 7/2004 | Moran | |
| 6,786,062 | B1 | 9/2004 | Greenberg | |
| 6,793,094 | B2 | 9/2004 | Turnbough | |
| 6,796,430 | B2 | 9/2004 | Mercier et al. | |
| 7,097,069 | B2 | 8/2006 | Cavanagh | |
| 7,124,604 | B2 | 10/2006 | Taylor et al. | |
| 7,168,583 | B2 * | 1/2007 | Freeman | 220/8 |
| 7,712,625 | B2 | 5/2010 | Alger | |
| 7,770,410 | B2 | 8/2010 | Cote | |
| 2002/0092855 | A1 | 7/2002 | Moran | |
| 2002/0134903 | A1 | 9/2002 | Lin | |
| 2004/0040968 | A1 | 3/2004 | Visser | |
| 2004/0074910 | A1 | 4/2004 | Fripps | |
| 2004/0195250 | A1 | 10/2004 | Fripps | |
| 2006/0059944 | A1 * | 3/2006 | Taylor et al. | 62/457.4 |
| 2006/0091141 | A1 | 5/2006 | Scott | |

* cited by examiner

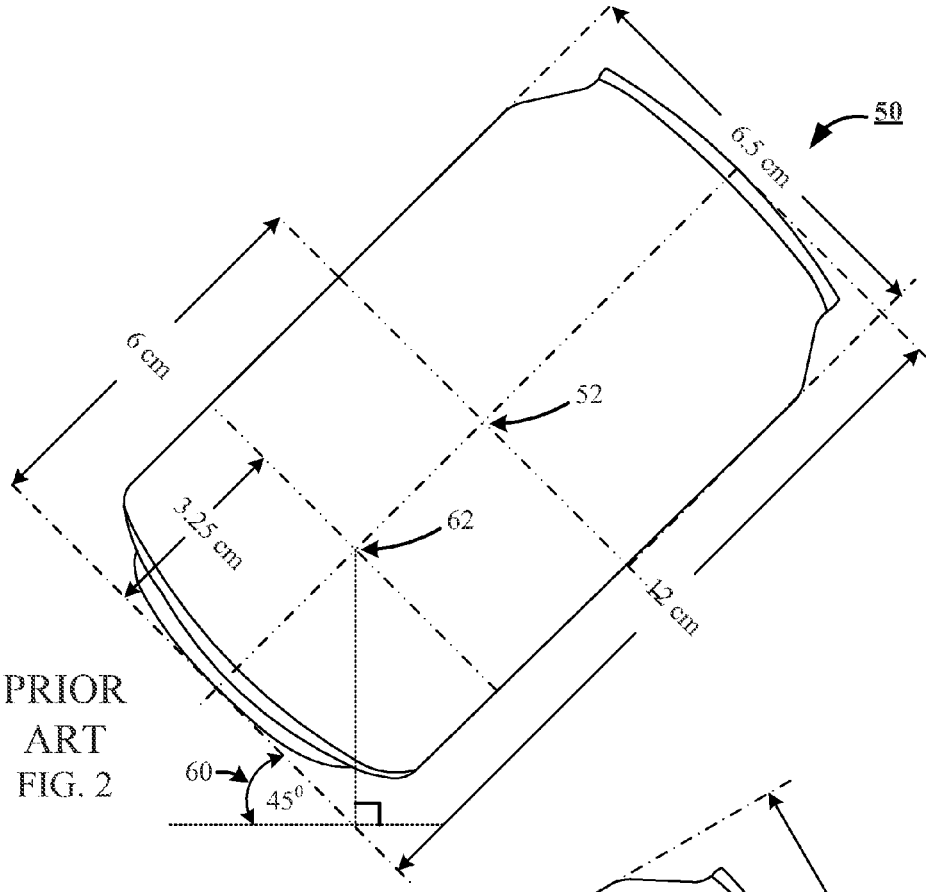
PRIOR ART FIG. 2
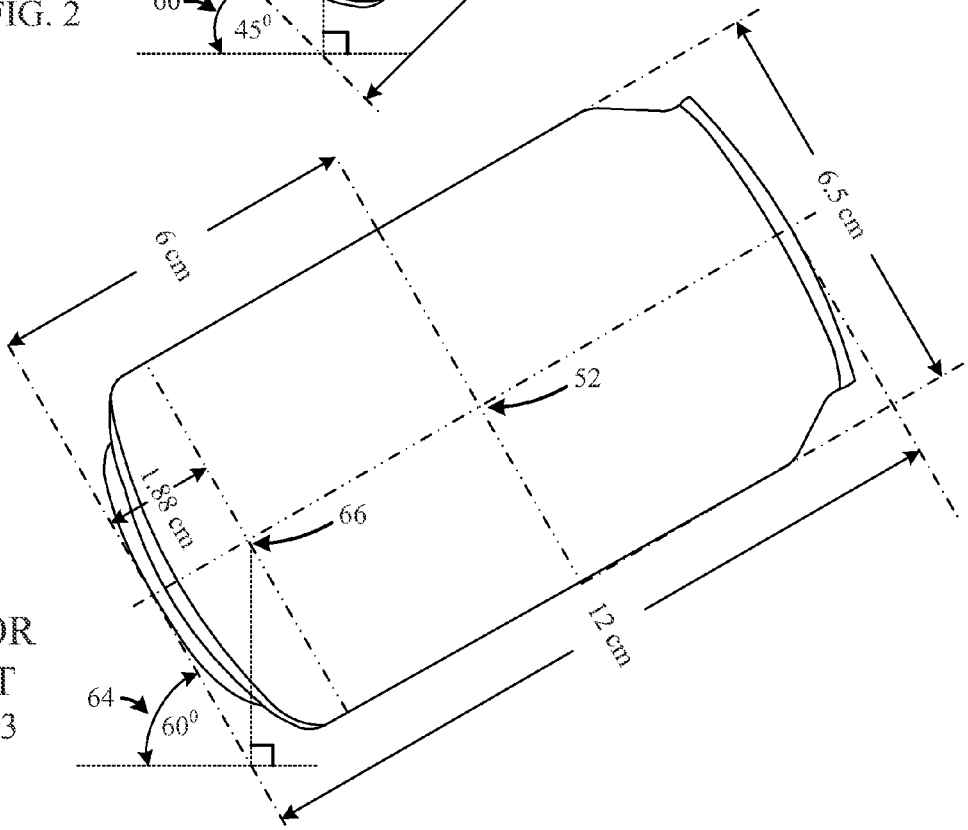
PRIOR ART FIG. 3

TIP RESISTANT BEVERAGE CONTAINER HAVING INTERNAL BALANCE MASS

RELATED APPLICATIONS

The present application is a divisional of parent copending U.S. patent application Ser. No. 11/406,613 filed on Apr. 19, 2006 which makes a claim of domestic priority under 35 U.S.C. §119(e) to U.S. Provisional Patent Application No. 60/672,714 filed Apr. 19, 2005, which are hereby incorporated by reference.

BACKGROUND OF THE INVENTION

1. Field of the Invention

The present invention relates to beverage containers. More particularly, but not by way of limitation, the present invention relates to beverage containers that resist an inadvertent toppling over of the beverage container.

2. Background of the Invention

Brewed beverages and soft drinks have been packaged in containers, such as metallic cans, for multiple decades, and problems with an inadvertent toppling over of the container have been common for the same period. Automobile makers have addressed the problem by including beverage holders in their vehicles. Parents have attempted to address the problem by serving their toddlers soft drinks in a tip resistant cup, that frequently include a lid that meters a limited amount of fluid over a given time. Although generally effective, at times the lid portion gets separated from the cup portion, a soft drink is served in the cup portion, and the soft drink ends up on the carpet. As such, challenges remain and a need persists for improvements in integrating tip resistant technology into direct relationship with beverage containers, and it is to these needs and challenges that the present invention is directed.

SUMMARY OF THE INVENTION

In accordance with a preferred embodiment, a beverage container that includes at least a bottom portion with a side portion extending from the bottom portion, and a balance mass in pressing engagement with the bottom portion is provided. Preferably, the bottom portion includes at least an inner surface and an outer surface, and in a preferred embodiment, the balance mass is adjacent the inner surface of the bottom portion.

In an alternate preferred embodiment, the balance mass is adjacent the outer surface of the bottom portion. In each embodiment, the balance mass includes at least a core portion encapsulated by an encapsulant, in which the density of the core is greater than the density of a beverage of the beverage container. In the alternate preferred embodiment, the balance mass further includes a tip lip portion with a condensate retention ridge, and a condensate aperture. The condensate retention ridge in cooperation with a side portion of the balance mass forms a condensate channel, and the condensate aperture drains condensate from the condensate channel.

The beverage container of the preferred embodiment, the encapsulant further features a side surface, a top surface adjacent the side surface, and a bottom surface separated from the top surface by the side surface. Preferably, the side surface provides a serration, wherein the serration is adjacent the interior wall of the side portion of the beverage container, and the bottom surface conforms to the inner surface of the bottom portion.

These and various other features and advantages which characterize the claimed invention will be apparent from reading the following detailed description and a review of the associated drawings.

BRIEF DESCRIPTION OF THE DRAWINGS

FIG. 2 provides an elevational view of the beverage container of FIG. 1 tilted at a first spill angle.

FIG. 3 illustrates an elevational view of the beverage container of FIG. 1 tilted at a second spill angle.

DESCRIPTION OF THE PREFERRED EMBODIMENTS

Before explaining the present invention in detail, it is important to understand that the invention is not limited in its application to the details of the construction illustrated, or by the steps of construction inherently present by way of illustration of the appended drawings. The invention is capable of other embodiments and of being practiced or carried out in a variety of ways. It is to be understood that the phraseology and terminology employed herein is for the purpose of description and does not impose limitation on the present invention.

Figure 1:
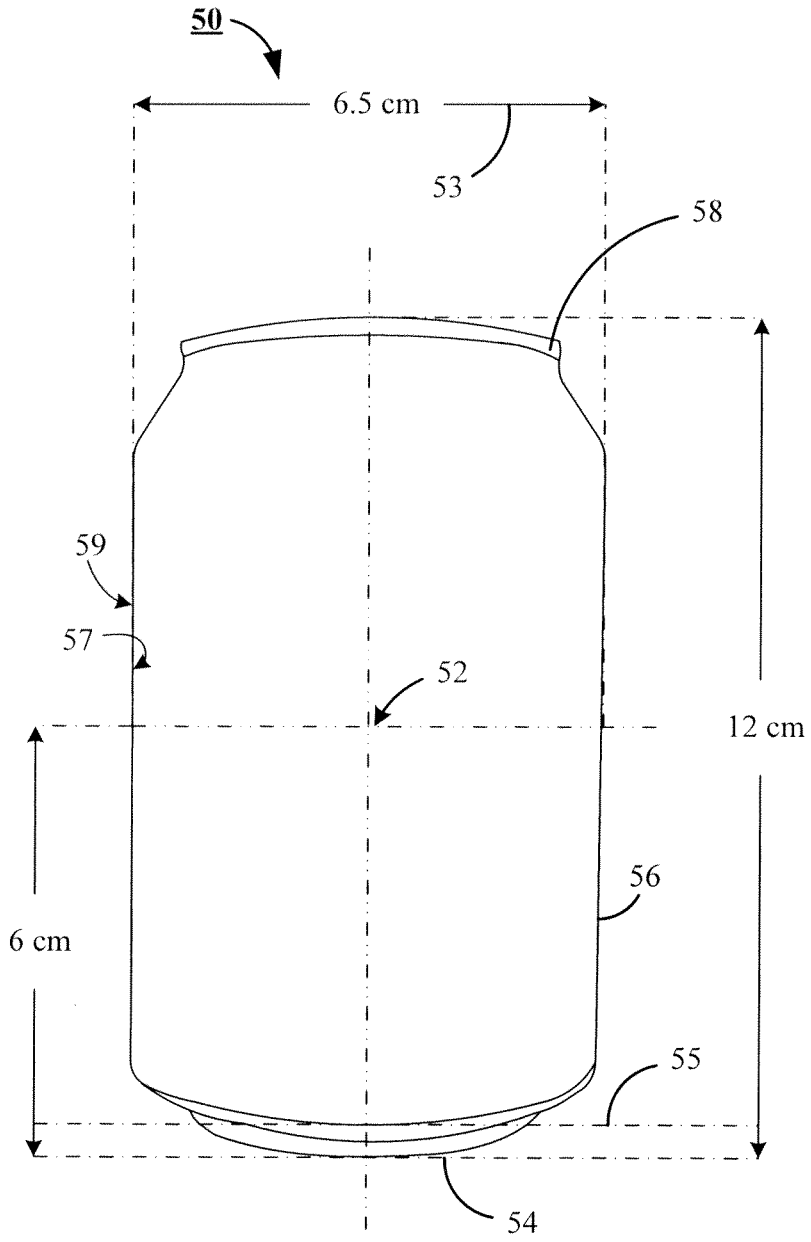
PRIOR ART FIG. 1
FIG. 1 shows an elevational view of a prior art beverage container.

Referring now to the drawings, and in particular to an example of a prior art beverage container 50 as shown in FIG. 1. Not by way of limitation, but by way of illustration only, the prior art beverage container 50 provides exemplary dimensions for use in describing changes in position of a center of mass 52 of a mass of substantially 340.2 grams (g). As shown by FIG. 1, the prior art beverage container 50 includes a bottom portion 54, a side portion 56 protruding from the bottom portion 54, wherein the side portion 56 provides a fixed diameter 53, and a lid portion 58 offset from the bottom portion 54 by the side portion 56. In an upright position, as shown by FIG. 1, and referencing the dimensions shown by FIG. 1 for the prior art beverage container 50, the center of mass 52 is located midway between the bottom portion 54 and the lid portion 58, and at the center point of a cylinder defined by the side portion 56, i.e., at substantially 6 cm away from the bottom portion 54 and set in substantially 3.25 cm from the side portion 56. FIG. 1 further shows the side portion 56 includes an interior wall 57 and a corresponding exterior wall 59 above a transition region 55. That is to say, the bottom portion 54 extends from the transition region 55 in a direction away from the lid portion 58, wherein the transition region is defined to be where the cylindrical side portion 56 transitions into an inward sloping conical section near the bottom of container 50.

Turning to FIG. 2, shown therein is a spill angle 60 of substantially 45 degrees, which is an angle at which the prior art beverage container 50 will overturn unless a change in the center of mass 52 of the prior art beverage container 50 occurs. That is, to keep the prior art beverage container 50 from overturning, the center of mass 52 must be moved from the center of mass 52 to a new center of mass 62. When the center of mass is moved from the center of mass 52 to a new center of mass 62, 72.92% of the original mass of the beverage contained within the prior art beverage container 50 is above the new center of mass 62.

To maintain a balance condition, i.e., to avert a tumbling over of the prior art beverage container 50, a mass substantially equal to 72.92% of the original mass of the beverage contained within the prior art beverage container 50 will need to be below the new center of mass 62. That is to say, the composite density of the material below the new center of mass 62 would need to be substantially 2.7 times the density of the beverage contained within the prior art beverage container 50. Because the prior art beverage container 50 has no such change in material density, the prior art beverage container 50 will overturn at a spill angle of substantially 45 degrees.

FIG. 3 shows a spill angle 64 of substantially 60 degrees. To maintain a balance condition, i.e., to avert a tumbling over of the prior art beverage container 50, a mass substantially equal to 84.42% of the original mass of the beverage contained within the prior art beverage container 50 will need to be below a new center of mass 66. That is to say, the composite density of the material below the new center of mass 66 would need to be substantially 5.44 times the density of the beverage contained within the prior art beverage container 50. Because the prior art beverage container 50 has no such change in material density, the prior art beverage container 50 will overturn at a spill angle of substantially 60 degrees.

Figure 4:
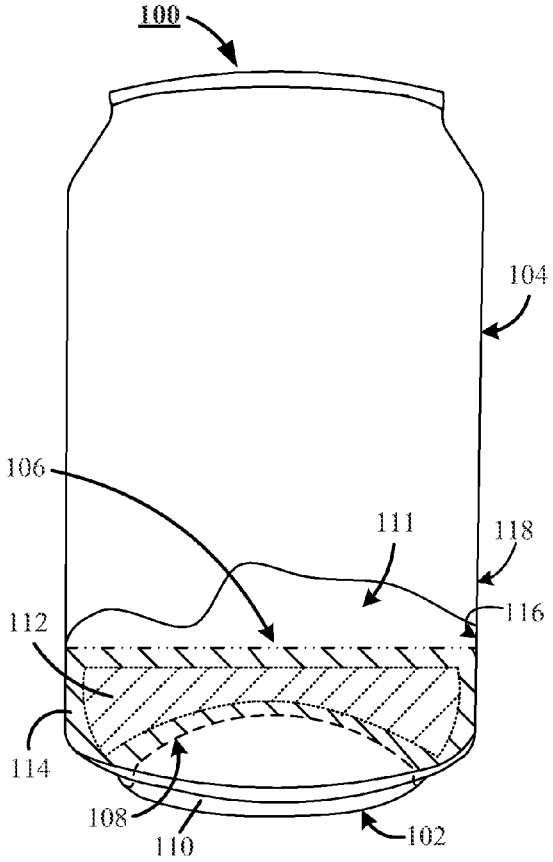
FIG. 4 illustrates an elevational, partial cutaway, partial cross-sectional, and partial hidden view of an inventive beverage container of the present invention.

Referring now to FIG. 4, and in particular to an inventive tip resistant beverage container "container" 100 shown therein. Not by way of limitation, but by way of illustration only, in a preferred embodiment the container 100 is particularly useful as a container for canned beverages, and includes at least a bottom portion 102 supporting a side portion 104, which extends from the bottom portion 102, and a balance mass 106 in pressing engagement with the bottom portion 102. Preferably, the bottom portion 102 further provides an inner surface 108 and an outer surface 110, wherein the balance mass 106 is in pressing engagement with the inner surface 108. In a preferred embodiment, the beverage container 100 is a beverage can.

The balance mass 106 preferably includes at least a core portion 112 encapsulated by an encapsulant 114. The encapsulant 114 is preferably formed from a polymer approved by the Federal Food and Drug Administration for use in confining foodstuffs. The composition of the core portion 112 is a function of a number of degrees of spill angle the container 100 can undergo and still recover to an upright position. As the spill angle from which the container 100 is to recover increases, an amount of volume within the container 100 allocated for use in housing the balance mass 106 decreases. A decreasing volume within the container 100 allocated for use in housing the balance mass 106 necessitates an increased density differential between the mass of the beverage contained by the container 100 and the mass of the core portion 112. That is, the density of the core portion 112 becomes a multiple of the density of the beverage contained by the container 100.

For example, and not by way of limitation, if a beverage 111 (also referred to herein as fluid 111) contained within the container 100 (with substantially identical dimensions to the prior art beverage container 50 of FIG. 3) has a mass of 280.20 grams and occupies 84.42% of the available volume of the container 100 (leaving 15.58% of the available volume for occupancy by the balance mass 106), and a desired spill angle is 60°, then the density of the balance mass 106 would be substantially 5.44 times the density of the beverage contained within the container 100. To maintain the container 100 in a balanced state at a 60° spill angle, the mass above a center of mass must be substantially equal to the mass below the center of mass (which in this case, the center of mass of the container 100 would be substantially identical to the center of mass 66 of the prior art beverage container 50 of FIG. 3).

Letting: V represent the available volume of the container 100; $M_1$ represent the mass above the center of gravity; $M_2$ represent the mass below the center of gravity; $D_1$ represent the density of the beverage; and $D_2$ represent the combined density of the balance mass 106, the following relationships hold:

$$M_1=M_2$$

$$D_1=M_1/(0.8442*V)$$

$$D_2=M_2/(0.1558*V)$$

$$M_1=D_1*(0.8442*V)$$

$$M_2=D_2*(0.1558*V)$$

$$D_1*(0.8442*V)=D_2*(0.1558*V)$$

$$D_1*(0.8442)=D_2*(0.1558)$$

$$D_2=D_1*(0.8442)/(0.1558)$$

$$D_2=5.44D_1$$

At a spill angle of 45°, the center of mass of the container 100 would be substantially identical to the center of mass 62 of the prior art beverage container 50 of FIG. 2, and the following relationship would hold:

$$M_1=M_2$$

$$M_1=D_1*(0.7292*V)$$

$$M_2=[D_1*(0.1150*V)]+[D_2*(0.1558*V)]$$

$$D_1V*[0.7292-0.1150]=D_2V*[0.1558]$$

$$D_1*[(0.6142)/(0.1558)]=D_2$$

$$D_2=3.88D_1$$

By the above example, one skilled in the art will recognize that the mass of the core portion 112 is directly proportional to spill angle. That is, the greater the number of degrees of spill angle present, the greater must be the mass of the core portion 112 to maintain the container 100 in a balanced state while encountering the spill angle.

Figure 5:
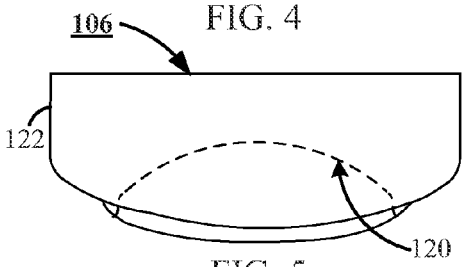
FIG. 5 provides an elevational and partial hidden view of a balance mass of the inventive beverage container of FIG. 4.

FIG. 4 further shows the side portion 104 includes an interior wall 116 and an exterior wall 118, while FIG. 5 shows the balance mass 106 is configured to conform to the inner surface 108 of the bottom portion 102 (of FIG. 4). Preferably, when the balance mass 106 is positioned within the container 100 (of FIG. 4), a bottom surface 120 of the balance mass 106 is in substantially continuous and pressing engagement with the inner surface 108 of the bottom portion 102. FIG. 5 further shows the balance mass 106 provides a side surface 122 that preferably is in pressing engagement with the interior wall 116 of the side portion 104 (of FIG. 4) when the bottom surface 120 of the balance mass 106 is in pressing engagement with the inner surface 108 of the bottom portion 102.

Figure 6:
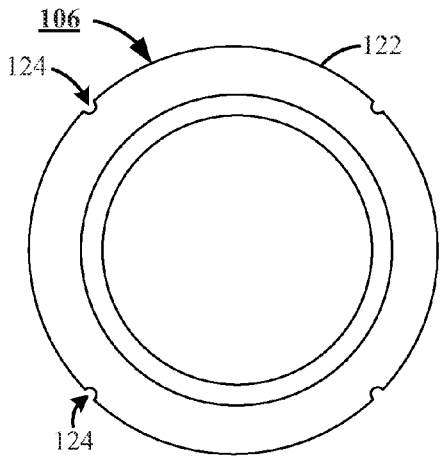
FIG. 6 shows a bottom plan view of the balance mass of FIG. 5.

FIG. 6 shows the side surface 122 provides a serration 124. In a preferred process, the serration 124 permits air to escape from between the bottom surface 120 of the balance mass 106 (of FIG. 4), and the inner surface 108 of the bottom portion 102 (of FIG. 4), while the bottom surface 120 (of FIG. 5) is being placed into pressing engagement with the inner surface 108.

Figure 7:
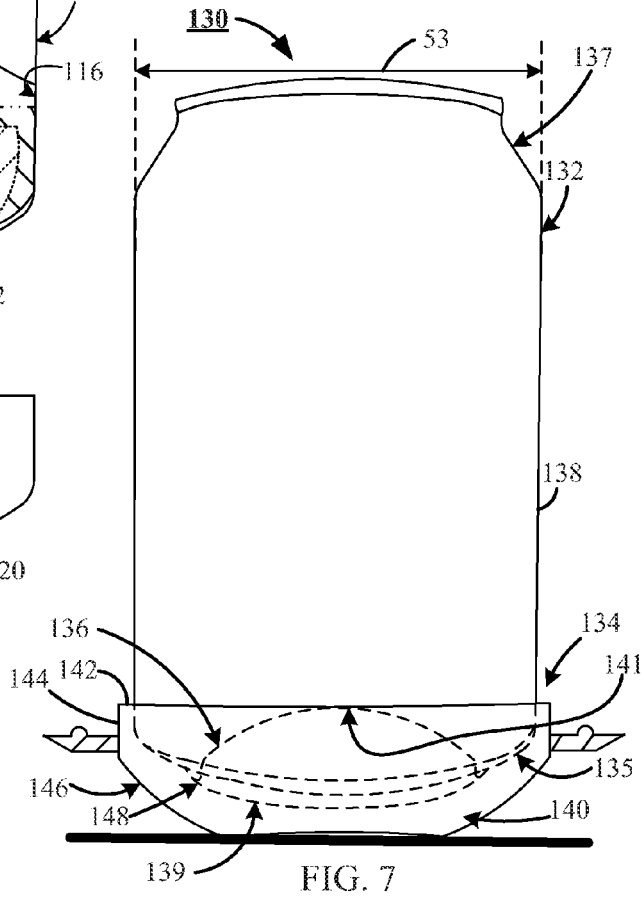
FIG. 7 shows an elevational, partial hidden line view of an alternate embodiment of the inventive beverage container of the present invention.

FIG. 7 shows an alternate embodiment of the present invention; an alternate container 130. The alternate container 130 includes at least a beverage container 132, and a balance mass 134. The beverage container 132 preferably includes a bottom portion 136 (shown in hidden line form), with a side portion 138 extending from the bottom portion 136. The balance mass 134 preferably includes an encapsulant 140. The encapsulant 140 preferably includes at least a top surface 142 adjacent a side surface 144, and a bottom surface 146 separated from the top surface 142 by the side surface 144, wherein the top surface 142 conforms to an outer surface 148 of the bottom portion 136. FIG. 7 further shows, the side portion 138 extends from a transition region 135 toward a lip region 137 of the beverage container 132, while the bottom portion 136 commences at the transition region 135 and extends from the transition region 135 in a direction away from the lip region 137 culminating at an interface surface 139 of the beverage container 132. It is noted that the transition region is defined to be where the side portion 138 transitions from a cylindrical shape, shown by FIG. 7, into an inward sloping conical section near the bottom of container 132. The rounded section, that portion of the container 132 where the side portion 138 with its cylindrical shape transitions into an inward sloping conical section near the bottom of container 132, forms a part of the bottom portion 136. The bottom portion further includes a concave area 141 commencing at the interface surface 139 and protruding toward the lip region 137. The side portion 138 commences at the transition region 135, culminates at the lip region 137 and preferably presents a fixed diameter 55 (of FIG. 1) along its entire length, which means that a cross-sectional area of the beverage container 132 taken at any point along the side portion 138 is the same as the cross-sectional area taken along any other point along the side portion 138.

Figure 8:
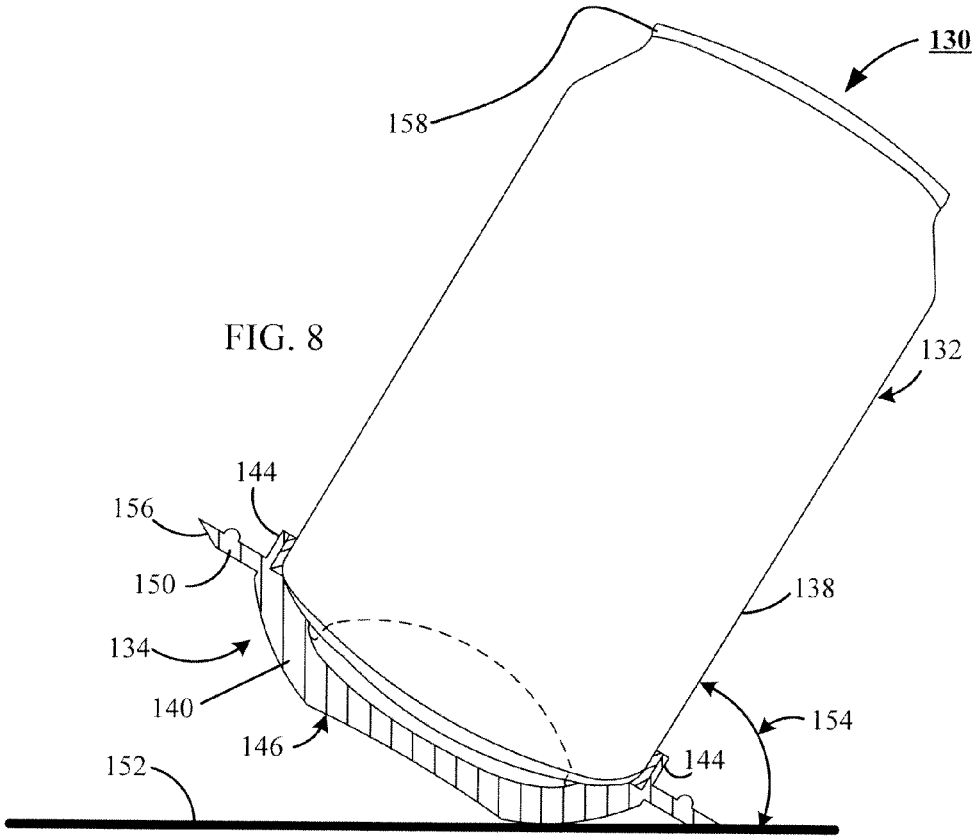
FIG. 8 provides an elevational view of the inventive beverage container of FIG. 7 tilted at a first spill angle.

FIG. 8 shows the encapsulant 140 further preferably includes a tip lip portion 150 extending radially from the side surface 144, wherein the tip lip portion 150 mitigates an inadvertent engagement of the side portion 138 with a container support surface 152 supporting the bottom surface 146. Further shown by FIG. 8 is a spill angle 154 defined as an angle between the side portion 138 and the container support surface 152, wherein upon encountering an angle greater than the spill angle 154, the side portion 138 contacts the container support surface 152.

The tip lip portion 150 further includes at least a tip engagement surface 156 on a distal portion of the tip lip portion 150, wherein upon encountering a tipping force sufficient to engender an angle between the side portion 138 and the container support surface 152 greater than the spill angle 154, the tip engagement surface 156 engages the container support surface 152 to preclude contacting engagement of the side portion 138 with the container support surface 152, and the balance mass 134 returns the side portion 138 to an upright position relative to the container support surface 152.

FIG. 8 further shows that the beverage container 132, preferably further includes a lid portion 158 offset from the bottom portion 136 by the side portion 138. Preferably, the side portion 138 has a predetermined overall length, and the tip lip portion 150 is offset from the lid portion 158 by a predetermined portion of the predetermined overall length of the side portion 138. At each predetermined portion of offset, the tip lip portion 150 forms a member of specific width, wherein each predetermined portion of offset is directly proportional to a mass of a core 160 (of FIG. 9), and wherein each specific width of the tip lip portion 150 associated with each predetermined portion of offset of the tip lip portion 150 from the lid portion 158 is indirectly proportional to the mass of the core 160. In other words, as the mass of the core 160 increases, the amount of offset of the tip lip portion 150 from the lid portion 158 increases, and as the mass of the core 160 increases, the width of the tip lip portion 150 decreases.

Figure 9:
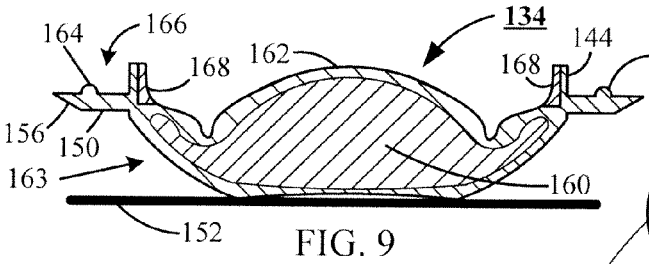
FIG. 9 illustrates an elevational cross-sectional view of a balance mass of the inventive beverage container of FIG. 7.

In addition to the core 160 of the balance mass 134, FIG. 9 further shows an encapsulant wall 162 enclosing the core 160, a condensate retention ridge 164 provided by the tip lip portion 150, a condensate channel 166 formed between the condensate retention ridge 164 and the side surface 144, and a friction portion 168 supported by the side surface 144, and wherein the encapsulant wall 162 directly contacting the core 160 forms a base region 163 of the balance mass 134, the base region 163, is in contacting adjacency with the container support surface 152. The encapsulant wall 162 is preferably formed from a polymer approved by the Federal Food and Drug Administration for use in confining foodstuffs, but may be formed from any ridged or semi-ridged material. The condensate retention ridge 164 confines condensate within the condensate channel 166 to preclude water marks on the container support surface 152 (of FIG. 8), and the friction portion 168 is preferably formed from a deformable polymer, such as polyurethane, which deforms an amount sufficient to impart a force against the side portion 138 of the beverage container 132 (of FIG. 8), to avert an unintentional dislodgement of the balance mass 134 from the beverage container 132.

Figure 10:
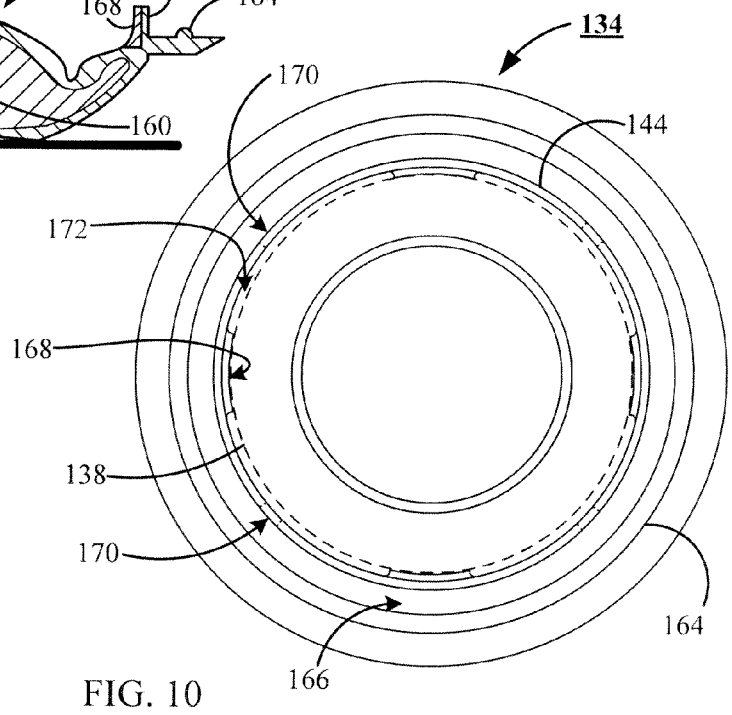
FIG. 10 provides a top plan view of the balance mass of FIG. 9.

FIG. 10 shows the balance mass 134 further includes a plurality of condensate apertures 170 extending from the condensate channel 166 and through the side surface 144. FIG. 10 further shows that the friction portions 168 are preferably distributed in various locals around the side surface 144. By distributing the friction portions 168 at various locals around the side surface 144, condensate collection cavities 172 are formed between the side portion 138 (shown by dashed lines) of the beverage container 132 (of FIG. 8), the side surface 144, and the friction portions 168. Preferably, the condensate apertures 170 extending from the condensate channel 166 and through the side surface 144 are aligned with the condensate collection cavities 172 to allow condensate collected in the condensate channel 166 to drain into the condensate collection cavities 172.

Figure 12:
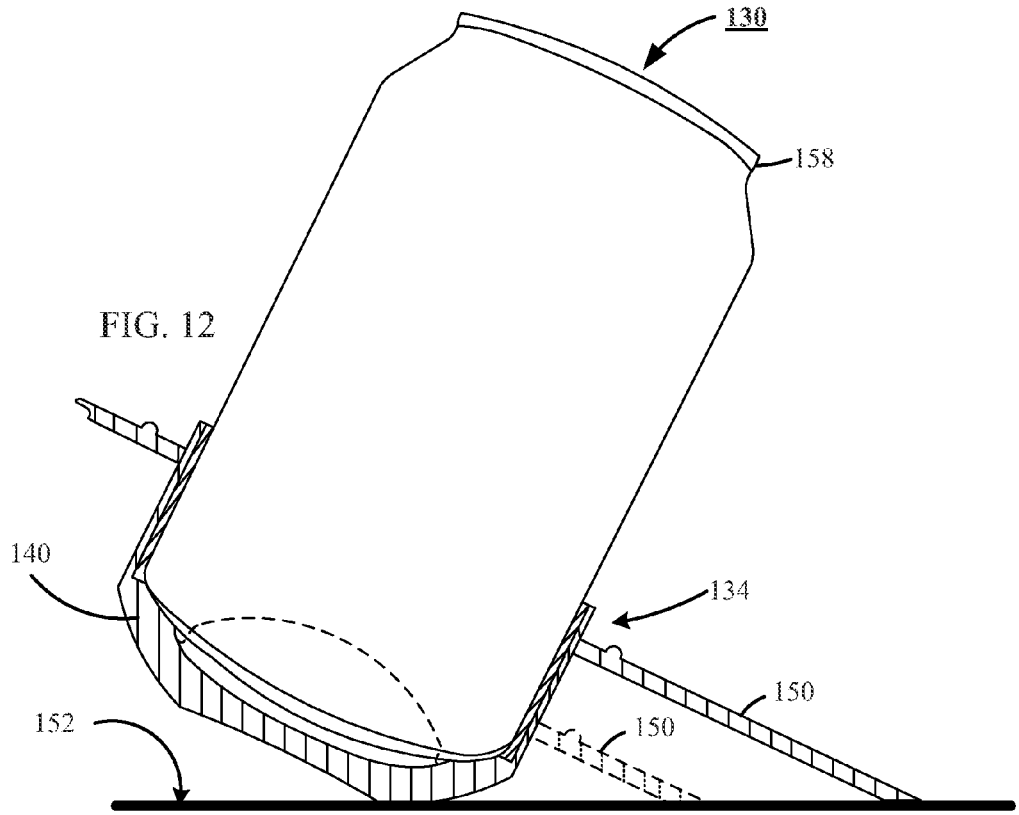
FIG. 12 illustrates a plan view of the balance mass of FIG. 11.
Figure 11:
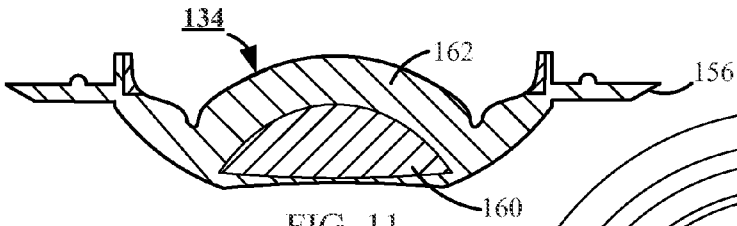
FIG. 11 provides an elevational view of the inventive beverage container of FIG. 7 tilted at a second spill angle.

Continuing with FIGS. 11 and 12, the embodiment shown therein is illustrative of an effect of reducing the mass of the core 160 of the balance mass 134. To assure the beverage container 132 is capable of returning to an upright position relative to the container support surface 152 when the mass of the core 160 is reduced, either the offset of the balance mass 134 from the lid portion 158 needs to be reduced and the width of the tip lip portion 150 needs to be increased, or the width of the tip lip portion 150 needs to be increased, relative to the width of the tip lip portion 150 of FIG. 9, as shown by FIG. 11.

Figure 13:
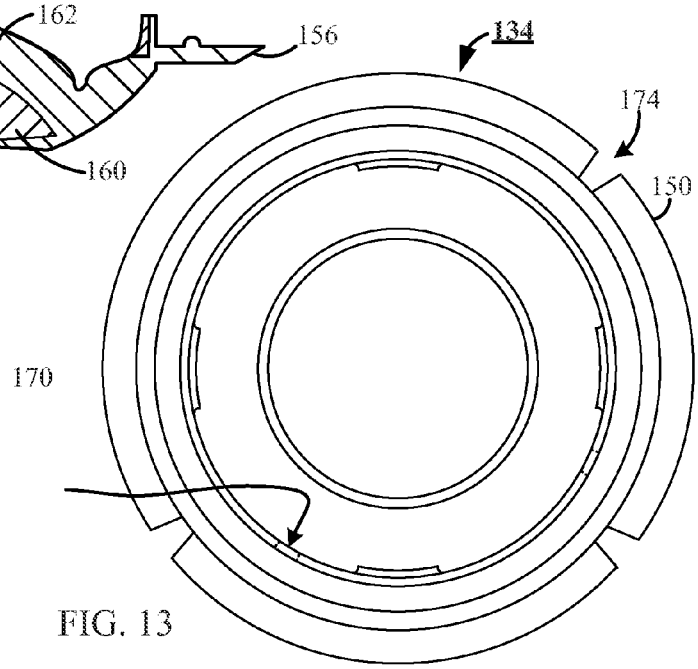
FIG. 13 shows a top plan view of the balance mass of FIG. 12.

FIG. 13 shows the inclusion of anti-roll notches 174 as an element of the embodiment of the balance mass 134 shown by FIG. 13, results in the tip lip portion 150 being a non-continuous member. The inclusion of the anti-roll notches 174 as an element of the tip lip portion 150 mitigates a potential tendency of the alternate container 130 (of FIG. 12) to roll on the tip engagement surface 156 (of FIG. 11) upon an inadvertent encountering of the tip engagement surface 156 with the container support surface 152 (of FIG. 12).

As will be apparent to those skilled in the art, a number of modifications could be made to the preferred embodiments which would not depart from the spirit or the scope of the present invention. While the presently preferred embodiments have been described for purposes of this disclosure, numerous changes and modifications will be apparent to those skilled in the art. Such changes and modifications are encompassed within the spirit of this invention.

What is claimed is:

1. A beverage container comprising:

a bottom portion;

a side portion extending from the bottom portion, the side portion includes at least an interior wall and a corresponding exterior wall; and a balance mass, in pressing engagement with the bottom portion, the balance mass includes at least a core portion encapsulated by an encapsulant, in which said encapsulant provides a top surface and a bottom surface, said bottom surface conforms to a geometric configuration of the bottom portion of the beverage container, and in which the encapsulant is in substantially continuous pressing engagement with the interior wall of the beverage container, and further in which, the encapsulant comprises a side surface with a serration, wherein the serration is adjacent the interior wall of the beverage container, and wherein the beverage container is a beverage can that contains a canned beverage, the canned beverage is in direct contact with the encapsulant.

2. The beverage container of claim 1, in which the bottom portion comprises an inner surface and an outer surface, and wherein the balance mass is adjacent the inner surface.

3. The beverage container of claim 2, in which the encapsulant further comprises a top surface adjacent the side surface and a bottom surface separated from the top surface by the side surface, wherein the bottom surface conforms to the inner surface of the bottom portion.

* * * * *